US005471969A

United States Patent [19]

McDonald, Jr.

[11] Patent Number: 5,471,969

[45] Date of Patent: Dec. 5, 1995

[54] STABILIZERS ADAPTED TO BE CONNECTED TO A BOW

[76] Inventor: Norman J. McDonald, Jr., Rte. 1, Box 155, Hendrix, Okla. 74741

[21] Appl. No.: 127,846

[22] Filed: Sep. 28, 1993

[51] Int. Cl.[6] ..... F41B 5/20

[52] U.S. Cl. ..... 124/89; 124/86

[58] Field of Search ..... 124/23.1, 86, 88, 124/89; 188/380; 267/136, 137, 225, 226; 42/1.06

[56] References Cited

U.S. PATENT DOCUMENTS

| | | | |
|---|---|---|---|
| 2,797,931 | 7/1957 | Hans | 188/380 X |
| 3,670,712 | 6/1972 | Izuta | 124/89 |
| 4,310,149 | 1/1982 | Camilleri | 267/136 |
| 4,615,327 | 10/1986 | Saunders | 124/89 |
| 4,893,606 | 1/1990 | Sisko | 124/89 |
| 4,982,719 | 1/1991 | Haggard et al. | 124/89 |
| 4,986,018 | 1/1991 | McDonald | 124/89 X |
| 5,044,351 | 9/1991 | Pfeifer | 124/89 |

OTHER PUBLICATIONS

Exhibit A–Fine Archery Products Brochure, undated.
Exhibit B–The Greek Custom Archery, Inc. Brochure, undated.
Exhibit C–The Greek Custom Archery, Inc. Brochure, undated.

*Primary Examiner*—Randolph A. Reese
*Assistant Examiner*—John A. Ricci
*Attorney, Agent, or Firm*—Dunlap & Codding

[57] ABSTRACT

A weight collar for use with a stabilizer adapted to be connected to a bow. The weight collar is removably connected to a stabilizer outer peripheral surface of the stabilizer. The weight collar includes a pad constructed of a compressible material whereby the weight collar is movable in upwardly and downwardly directions perpendicular to an axial center line of the weight collar and movable in angular directions relative to the axial center line of the weight collar while remaining attached to the weight collar. A stabilizer for use with a bow having a stabilizer tube with an opening extending therethrough forming a stabilizer chamber, the stabilizer chamber defining a stabilizer in a peripheral surface. A resonator suppressor ring is disposed in the stabilizer chamber between the first and the second ends of the stabilizer tube. The resonator suppressor ring is expanded in the stabilizer chamber to a position wherein a resonator outer peripheral surface engages the stabilizer inner peripheral surface and the resonator suppressor ring divides the stabilizer chamber into a first chamber and a second chamber, a piston and springs being disposed in the first chamber and another piston and springs being disposed in the second chamber. A piston assembly for use in the stabilizer where the piston assembly comprises a plurality of stacked piston rings.

20 Claims, 5 Drawing Sheets

STABILIZERS ADAPTED TO BE CONNECTED TO A BOW

FIELD OF THE INVENTION

The present invention relates to stabilizers adapted for use with bows and, more particularly, but not by way of limitation, to a weight collar disposed on the outer peripheral surface of a stabilizer which is movable in upwardly and downwardly directions and in angularly directions, and to a resonator suppressor ring which is disposed within a stabilizer chamber of a stabilizer for dividing the stabilizer chamber into a first chamber and a second chamber, and to disrupt the resonating sounds created by the bow that are very undesirable.

BRIEF DESCRIPTION OF THE DRAWINGS

FIG. 6 is a exploded view of the resonator suppressor ring of FIGS. 4 and 5.

DESCRIPTION OF THE PREFERRED EMBODIMENTS

Figure 1:
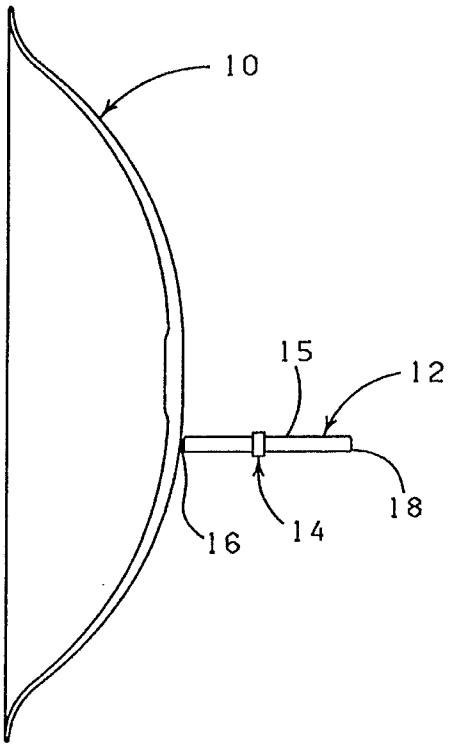
FIG. 1 is a diagrammatic representation of a bow having a stabilizer connected thereto with a weight collar constructed in accordance with the present invention being disposed on the stabilizer.

Shown in FIG. 1 is a diagrammatic representation of a bow 10 adapted to fire an arrow (not shown) in a manner well known in the art and having a stabilizer 12 connected thereto. A weight collar 14 is removably connected to the stabilizer 12.

When an arrow is fired from the bow 10, a recoil action and vibration results which misdirects the arrow and results in undesired noise. The weight collar 14 cooperates with the stabilizer 12 to reduce such vibrations and change the balance point of the bow and add weight to the stabilizer 12.

The stabilizer 12 consists of a hollow tube 15 (FIGS. 1 and 3) having a first end 16 (FIG. 1) and a second end 18 (FIG. 1). The tube 15 has a stabilizer outer peripheral surface 19 (FIG. 3) forming a stabilizer outer diameter 21 (FIG. 3).

Generally, a piston and springs along with a fluid are disposed in the hollow portion of the stabilizer 12, although it should be noted that the weight collar 14 is not limited to use with a stabilizer of this particular construction.

Figure 2:
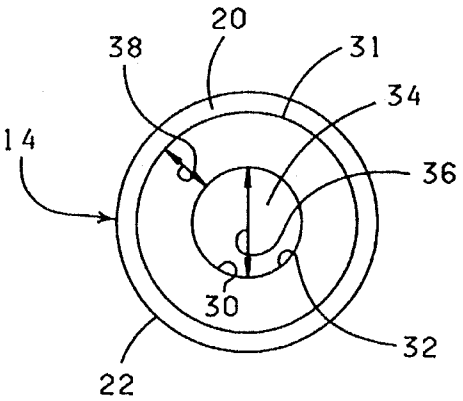
FIG. 2 is an end elevational view of the weight collar of FIG. 1.
Figure 3:
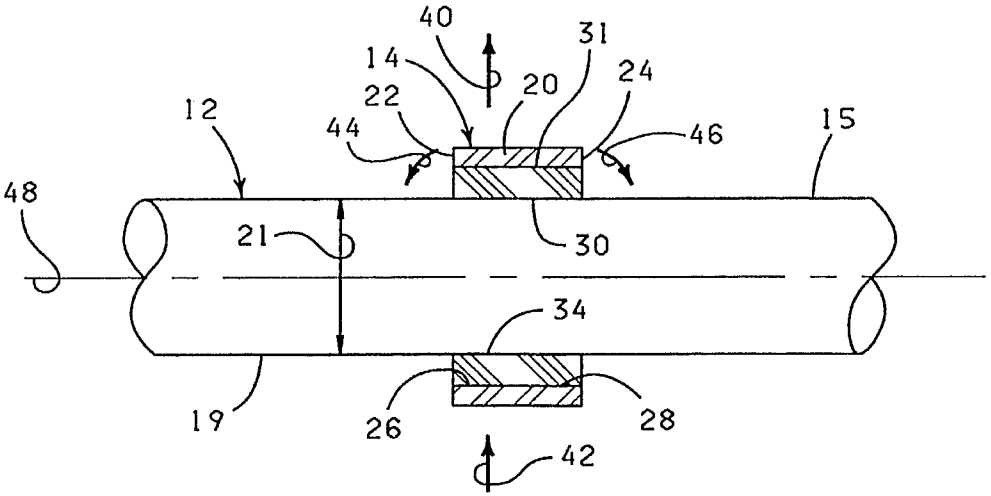
FIG. 3 is a sectional view of the weight collar of FIGS. 1 and 2 with the weight collar being shown disposed on the stabilizer (only a fragmentary portion of the stabilizer being shown in FIG. 3).

As shown more clearly in FIGS. 2 and 3, the weight collar 14 comprises a ring 20 constructed of a relatively rigid, metal material. The ring 20 is generally cylindrically shaped. The ring 20 has a first end 22 (FIGS. 2 and 3) and a second end 24 (FIG. 3). The ring 20 has a ring opening 26 extending through a central portion thereof intersecting the first and the second ends 22 and 24. The ring opening 26 forms a ring inner peripheral surface 28.

As shown in FIGS. 2 and 3, a pad 30 is connected to the ring inner peripheral surface 28 and portions of the pad 30 extend radially outwardly from the ring inner peripheral surface 28 terminating with a pad inner end 34. The pad 30 as shown in FIGS. 2 and 3 is a unitary, solid construction and thus the pad inner end 32 more particularly defines an inner peripheral surface, although the pad 30 could be constructed of segments with each of the segments extending radially inwardly and the inner ends of each of the segments forming the pad inner end 32 if desired in a particular application. The pad inner end 32 defines a pad opening 34 (FIGS. 2 and 3) having a pad diameter 36 (FIGS. 2). The pad diameter 36 is slightly less than the stabilizer outer diameter 21 in an uncompressed condition of the pad 30, as will be described in greater detail below.

The pad 30 is generally cylindrically shaped and has a pad outer peripheral surface 31 (FIGS. 2 and 3).

The pad 30 has a pad thickness 38 extending between the pad outer peripheral surface 31 and the pad inner end 32 (FIG. 2) in an uncompressed condition of the pad 30.

The pad 30 is constructed of a compressible material. Preferably, the pad 30 is constructed of a foam material. One foam-like material which has been found suitable for use as the pad 30 is a foam pad commercially available from Kavco Industries, Inc. of Fort Worth, Tex.

The pad outer peripheral surface 31 is secured to the ring inner peripheral surface 28. In one embodiment, the pad 30 may be adhesively connected to the ring inner peripheral surface 28.

The pad opening 34 is aligned with the stabilizer outer peripheral surface 19 generally at the first end 16 or the second end 18 of the stabilizer 12.

In this position, the weight collar 14 is forcibly moved over the stabilizer 12 with the stabilizer 12 being disposed through the pad opening 34. The weight collar 14 is moved to position the weight collar 14 at a position generally midway between the first and the second ends 16 and 18 of the stabilizer 12 or any place on the stabilizer to change balance or add weight. The weight collar 14 may be located closer to one end of the stabilizer 12 for better balance of the bow if desired. Since the pad diameter 36 in the uncompressed condition is less than the stabilizer outer diameter 21, the stabilizer 12 compresses the pad 30 as the weight collar 14 is moved over the stabilizer outer peripheral surface 19 so that the pad 30 grippingly engages the stabilizer outer peripheral surface 19 to secure the pad 30 in the assembled position and a compressed condition of the pad 30 disposed on the stabilizer outer peripheral surface 19.

The pad thickness 38 is sufficiently large and the material from which the pad 30 is constructed is sufficiently compressible so that the weight collar 30 assembled on the stabilizer 12 is movable in radially outwardly directions 40 (FIG. 3), radially inwardly directions 42 (FIG. 3) and in angularly directions 44 (FIG. 3) and 46 (FIG. 3).

Each of the directions 40, 42, 44 and 46 is with respect to an axial centerline 48 (FIG. 3) of the stabilizer 12 or the weight collar 14 (the axial centerline 48 represents the axial centerline of the stabilizer 12 and the weight collar 14).

The additional weight of the weight collar 14 helps stabilize the bow 10 and reduce vibrations and noise. When the bow 10 is fired, the weight collar 14 is movable in the directions 40, 42, 44 and 46 whereby the pad 30 cooperates to reduce the vibrations thereby reducing the noise resulting from the firing of the bow 10 or, more particularly, resulting from the vibrations caused by the firing of the bow 10.

Figure 4:
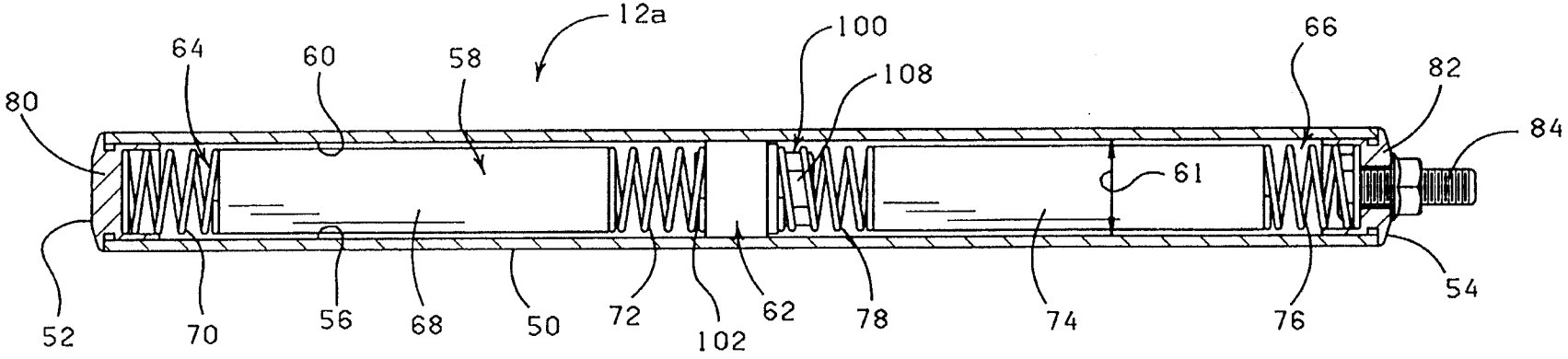
FIG. 4 is a sectional view of a stabilizer having a resonator suppressor ring disposed therein and dividing a stabilizer chamber into a first and a second chamber.

A stabilizer 12*a* is shown in greater detail in FIG. 4. The stabilizer 12 shown in FIGS. 1 and 3 may comprise the stabilizer 12*a*, although the stabilizer 12 shown in FIGS. 1 and 3 is not limited to a stabilizer of any particular construction.

The stabilizer 12*a* comprises a stabilizer tube 50 having a first end 52 and a second end 54. An opening 56 is formed through the stabilizer tube 50. The opening 56 defines a stabilizer chamber 58 and defines a stabilizer inner peripheral surface 60. The stabilizer inner peripheral surface 60 defines a stabilizer inner diameter 61.

A resonator suppressor ring 62 is disposed in the stabilizer chamber 58 and positioned about midway between the first and the second ends 52 and 54 of the stabilizer tube 50. The resonator suppressor ring 62 divides the stabilizer chamber 58 into a first chamber 64 and a second chamber 66.

The resonator suppressor ring 62 reduces resonating sounds which are undesirable when firing a bow.

A first piston 68 is slidingly disposed in the first chamber 64. Two springs 70 and 72 are disposed in the first chamber 64. One end of the spring 70 engages the first end 52 of the stabilizer tube 50 and the opposite end of the spring 70 engages one end of the first piston 68. One end of the spring 72 engages the opposite end of the first piston 68 and the opposite end of the spring 72 engages one end of the resonator suppressor ring 62. A second piston 74 is disposed in the second chamber 66. A pair of springs 76 and 78 also are disposed in the second chamber 66. One end of the spring 76 engages the second end of the stabilizer tube 50 and the opposite end of the spring 76 engages one end of the second piston 74. One end of the spring 78 engages the opposite end of the second piston 74 and the opposite end of the spring 78 engages one end of the resonator suppressor ring 62.

The first and the second pistons 68 and 74 cooperate with the springs 70, 72, 76 and 78 for reducing vibration in a manner well known in the art. Preferably, hydraulic fluid is disposed in the first and the second chambers 64 and 66.

The first end 52 of the stabilizer tube 50 is closed by way of a cap 80. The second end 54 of the stabilizer tube 50 is closed by way of a cap 82.

A threaded member 84 is connected to the cap 82 on the second end 54 of the stabilizer tube 50. The threaded member 84 extends a distance from the first end 52. The threaded member 84 provides a means for threadedly connecting the stabilizer 12*a* to the bow 10 in a manner well known in the art.

Figure 5:
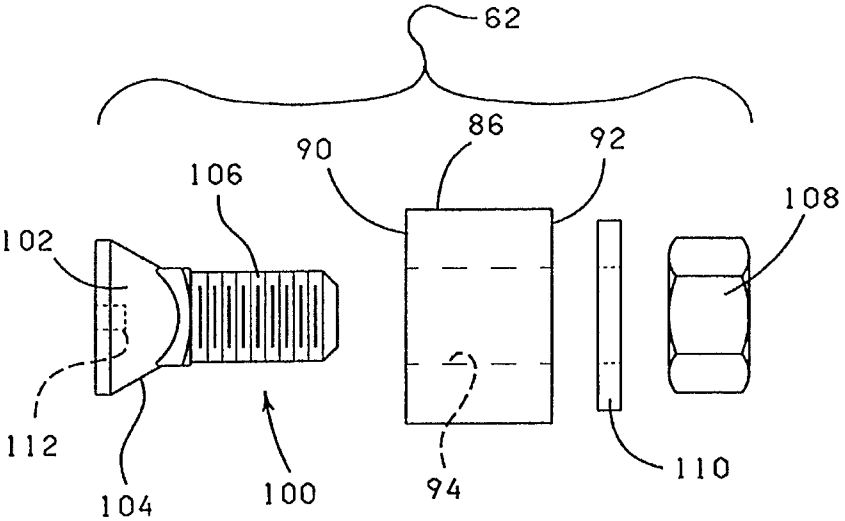
FIG. 5 is a sectional view of the resonator suppressor ring of FIG. 4.
Figure 5:
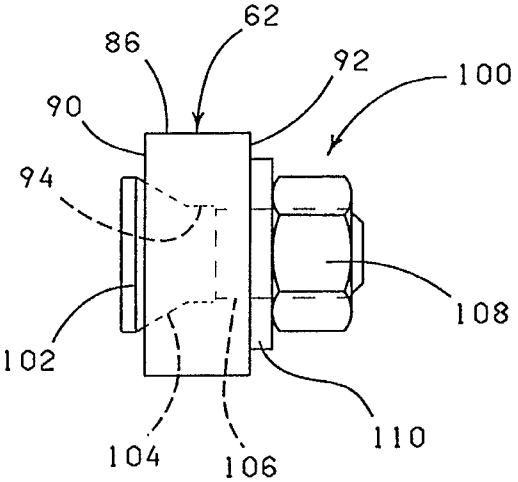
Figure 7:
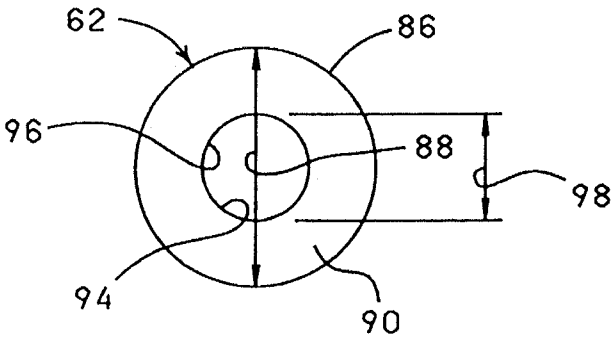
FIG. 7 is an end elevational view of a ring portion of the resonator suppressor ring of FIGS. 4, 5 and 6.

The resonator suppressor ring 62 is shown in more detail in FIGS. 5, 6 and 7. The resonator suppressor ring 62 is generally cylindrically shaped.

The resonator suppressor ring 62 has a suppressor outer peripheral surface 86 defining an outer diameter 88 (FIG. 7) of the resonator suppressor ring 62.

The resonator suppressor ring 62 has a relaxed condition (FIGS. 6 and 7) and an expanded condition (FIGS. 4 and 5). In the relaxed condition, the suppressor outer diameter 88 is slightly less than the stabilizer inner diameter 61. In the expanded condition, the suppressor outer diameter 88 is slightly greater than the stabilizer inner diameter 61.

The resonator suppressor ring 62 is generally cylindrically shaped and has a first end 90 and a second end 92. An expander opening 94 (FIGS. 5 and 6) is formed through the resonator suppressor ring 62. The expander opening 94 intersects the first end 90 and the second end 92. The expander opening 94 forms a expander inner peripheral surface 96 (FIG. 7) defining an expander inner diameter 98 (FIG. 7).

An expander assembly 100 (FIGS. 4, 5 and 6) is movably connected to the resonator suppressor ring 62. The expander assembly 100 is adapted to engage the resonator suppressor ring 62 and move the resonator suppressor ring 62 from the relaxed condition to the expanded condition in one position of the expander assembly 100 and to move the resonator suppressor ring 62 from the expanded condition to the relaxed condition in one other position of the expander assembly 100.

The expander assembly 100 includes a tapered member 102 (FIGS. 4, 5 and 6) having a frusto-conically shaped tapered surface 104 (FIGS. 5 and 6) formed thereon. A threaded member 106 (FIGS. 5 and 6) is connected to the tapered member 102. The threaded member 106 extends a distance from the tapered member 102.

The expander assembly 100 also includes a nut 108 (FIGS. 4, 5 and 6) and a washer 110 (FIGS. 5 and 6). A slot 112 (FIG. 6) is formed in the tapered member 102.

In an assembled position, the tapered member 102 is positioned in the expander opening 94 generally adjacent the first end 90 of the resonator suppressor ring 62 with the tapered member 102 extending through the expander opening 94 and extending a distance outwardly from the second end 92 of the resonator suppressor ring 62. The washer 110 is disposed over the threaded member 106 and disposed generally adjacent the second end 92 of the resonator suppressor ring 62. The nut 108 is threadingly disposed on the threaded member 106 with the nut 108 being disposed generally adjacent the second end 92 of the resonator suppressor ring 62.

In this assembled position, the tapered surface 104 initially engages a portion of the suppressor inner peripheral surface 96 generally adjacent the first end 90 and the suppressor outer diameter 88 is slightly less than the stabilizer inner diameter 61 with the resonator suppressor ring 62 in the relaxed condition. In this relaxed condition, the resonator suppressor ring 62 with the expander assembly 100 connected thereto is insertable through the stabilizer chamber 58 to the position shown in FIG. 4 wherein the resonator suppressor ring 62 is disposed at a position generally midway between the first and the second ends 52 and 54 of the stabilizer tube 50. After the resonator suppressor ring 62 with the expander assembly 100 connected thereto has been disposed in the stabilizer chamber 58 at the predetermined proper position, the operator rotates the nut 108 thereby threadedly moving the threaded member 106 through the nut 108. This movement causes the tapered surface 104 to be moved into the suppressor opening 94 with the tapered surface 104 continually engaging the suppressor inner peripheral surface 96 and forcing the resonator suppressor ring 62 radially outwardly thereby expanding or increasing the suppressor outer diameter 88 and moving the resonator suppressor ring 62 to the expanded position. As the nut 108 is rotated and the resonator suppressor ring 62 is moved to the expanded position, the suppressor outer peripheral surface 86 sealingly and forcibly engages the stabilizer inner peripheral surface to firmly lock or secure the resonator suppressor ring 62 within the stabilizer chamber 58.

If it is desired to move the resonator suppressor ring 62, the nut 108 is rotated in the manner described before (but in opposite direction) thereby loosening the threaded engagement between the threaded member 106 and the nut 108 in removing the tapered member 102 from a substantial portion of the suppressor opening 94, thereby allowing the resonator suppressor ring 62 to be moved from the expanded condition to the relaxed condition wherein the suppressor outer diameter 88 again is less than the stabilizer inner diameter 61. In this relaxed condition, the resonator suppressor ring 62 with the expander assembly 100 connected thereto can be removed from the stabilizer tube 50.

In one preferred embodiment, the resonator suppressor ring 62 is an air conditioner hose of the type used in automotive air conditioning systems. Such members are commercially available from various sources such as Jimmies Automotive of Durant, Okla., Gates-8AC51, Fram SAEJ51 Type AZ 13/22 GLO 4212.

In one preferred embodiment, the resonator suppressor ring 62 has no openings or openings other than the expander opening 94. In this embodiment, as shown in FIGS. 4, 5, 6 and 7, fluid in the first chamber 64 is isolated from fluid in the second chamber 66 and the resonator suppressor ring 62 functions to fluidically isolate the first chamber 64 from the second chamber 66.

In other embodiments, an additional opening may be formed through the resonator suppressor ring 62 to permit fluid to flow between the first chamber 64 and the second chamber 66 if this is desired in some applications.

It should be noted that the suppressor ring 62 can be constructed with no expander assembly where the resonator suppressor ring 62 has an outside diameter larger than the inside diameter of the stabilizer tube. In this instance, the resonator suppressor ring is compressed and forced into the stabilizer tube in the expanded position and removed from the stabilizer tube with the removed resonator suppressor ring being in the relaxed condition.

Figure 8:
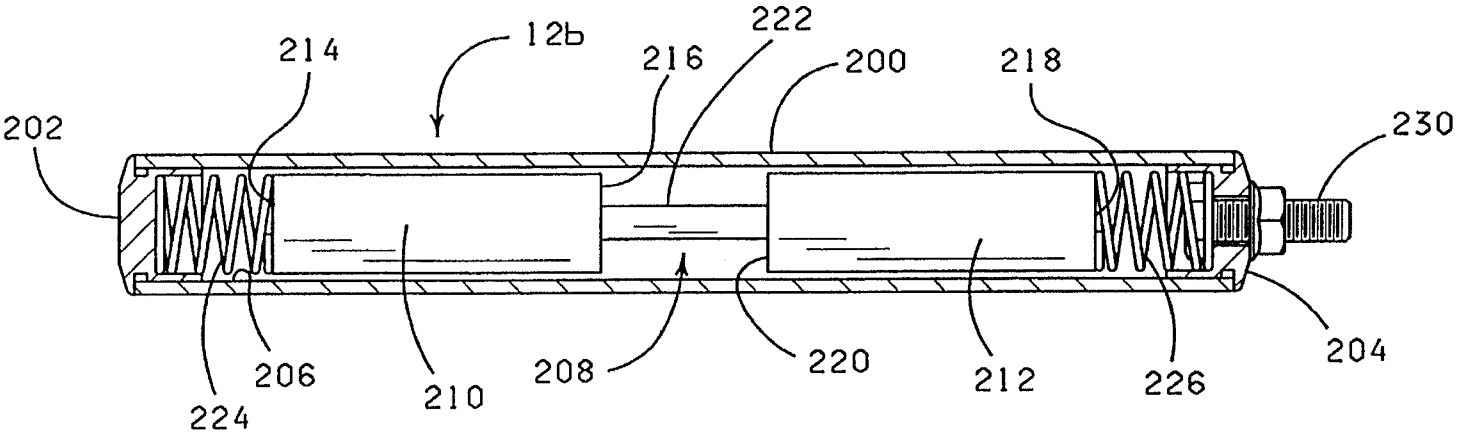
FIG. 8 is a sectional view of a modified stabilizer having two pistons disposed in a stabilizer chamber.

Shown in FIG. 8 is another modified stabilizer 12*b*. Stabilizer 12*b* comprises a stabilizer tube 200 having a first end 202 and a second end 204. An opening 206 is formed through the stabilizer tube 200 and defines a stabilizer chamber 208. The first and the second ends 202 and 204 of the stabilizer 12*b* are closed by way of caps in the manner described before with respect to the other stabilizers disclosed herein.

A first piston 210 is slidingly disposed in the stabilizer chamber 208. A second piston 212 is slidingly disposed in the stabilizer chamber 208.

The first piston 210 has a first end 214 and a second end 216. The second piston 212 has a first end 218 and a second end 220. The second end 216 of the first piston 210 is connected to the second end 220 of the second piston 212 by way of a connector 222.

A first spring 224 is disposed in the stabilizer chamber 208. A portion of the first spring 224 engages a first end 202 of the stabilizer tube 200 and another portion of the first spring 224 engages the first end 214 of the first piston 210.

A second spring 226 is disposed in the stabilizer chamber 208. A portion of the second spring 226 engages a portion of the second end 204 of the stabilizer tube 200 and another portion of the second spring 226 engages a portion of the first end 218 of the second piston 212.

A threaded member 230 is connected to the second end 204 of the stabilizer tube 200 for connecting the stabilizer 12*b* to the bow in a manner generally described before.

Hydraulic fluid and/or air is disposed in the stabilizer chamber 208. The inner diameter of the tube is larger than the diameter of the piston so the hydraulic fluid will flow around the piston.

Figure 9:
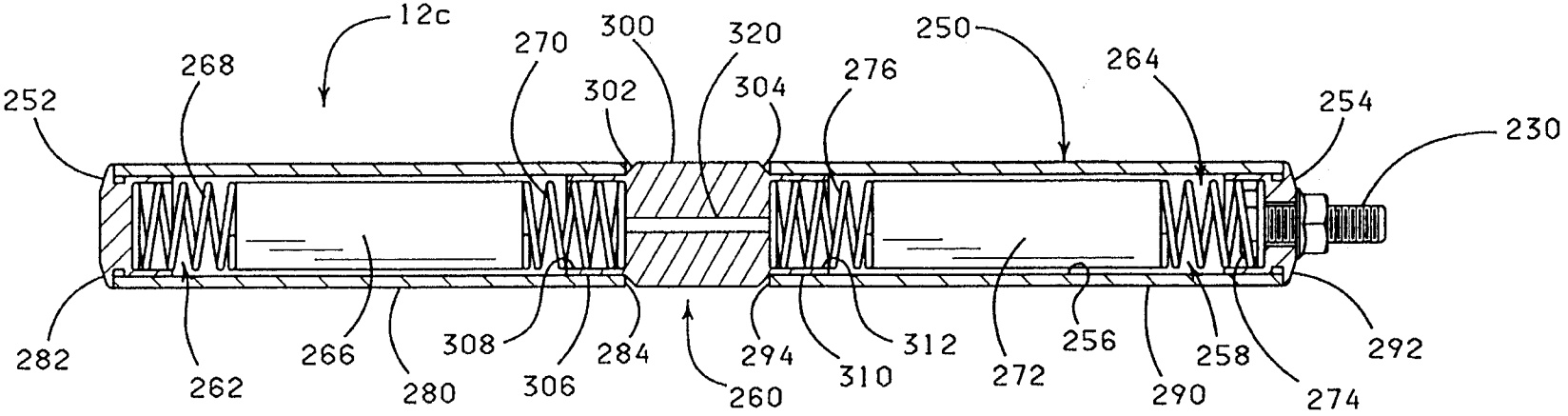
FIG. 9 is a sectional view of another modified stabilizer having a divider ring dividing the stabilizer tube into a first chamber and a second chamber.

It should be noted that, although only two pistons 210 and 212 are shown in FIG. 9, the stabilizer 12*b* may include more than two pistons interconnected in the manner described before with respect to the interconnection of the first piston 210 and the second piston 212.

Shown in FIG. 9 is another modified stabilizer 12*c*. The stabilizer 12*c* comprises a stabilizer tube 250. The stabilizer tube 250 has a first end 252 and a second end 254. An opening 256 is formed through the stabilizer tube 250 forming a stabilizer chamber 258 within the stabilizer tube 250.

A divider 260 is interposed in the stabilizer tube 250 generally midway between the first and the second ends 252 and 254 dividing the stabilizer chamber 258 into a first chamber 262 extending generally between the first end 252 of the stabilizer tube 250 and the divider 260 and a second chamber 264 extending generally between the second end 254 of the stabilizer tube 250 and the divider 260.

A first piston 266 is disposed in the first chamber 262. A pair of springs 268 and 270 also are disposed in the first chamber 262. A portion of the spring 268 engages the first end 252 of the stabilizer tube 250 and another portion of the spring 268 engages one end of the first piston 266. One portion of the spring 270 engages one end of the first piston 266 and an opposite portion of the spring 270 engages a portion of the divider 260.

A piston 272 is disposed in the second chamber 264. A pair of springs 274 and 276 are disposed in the second chamber 264. A portion of the spring 274 engages the second end 254 of the stabilizer tube 250 and another portion of the spring 274 engages a portion of the piston 272. A portion of the spring 276 engages a portion of the piston 272 and another portion of the spring 276 engages a portion of the divider 260.

Air and/or hydraulic fluid may be disposed in either one or both of the chambers 262 and 264.

More particularly, the stabilizer tube 250 is divided into a first tube segment 280. The first tube segment 280 has a first end 282 forming the first end 252 of the stabilizer tube 250 and a second end 284. An opening is formed through the first tube segment 280 forming the first chamber 262. The stabilizer tube 250 also comprises a second tube segment 290 having a first end 292 forming the second end 254 of the stabilizer tube 250 and a second end 294. An opening is formed through the second tube segment 290 forming the second chamber 264.

The divider 260 comprises a divider ring 300 having a first end 302 and a second end 304. A first protrusion 306 extends from the first end 302 of the divider ring 300 and a recess 308 is formed in the first protrusion 306.

A second protrusion 310 extends from the second end 304 of the divider ring 300 and a recess 312 is formed in the second protrusion 310.

The second end 284 of the first tube segment 280 is press fitted over the first protrusion 306 and secured to the first end 302 of the divider ring 300. The second end 294 of the second tube segment 290 is press fitted over the second protrusion 310 and secured to the second end 304 of the divider ring 300.

An opening 320 is formed through the divider ring 300 intersecting the first and the second ends 302 and 304. The opening 320 provides fluidic communication between the first chamber 262 and the second chamber 264.

It should be noted that in some embodiments as may be desired in a particular application, the opening 320 may be omitted or deleted so that the divider ring 300 fluidically isolates the first chamber 262 from the second chamber 264.

It should be noted that the divider 260 also acts as a resonator suppressor in a manner like that described before with respect to the resonator suppressor ring 62.

Figure 10:
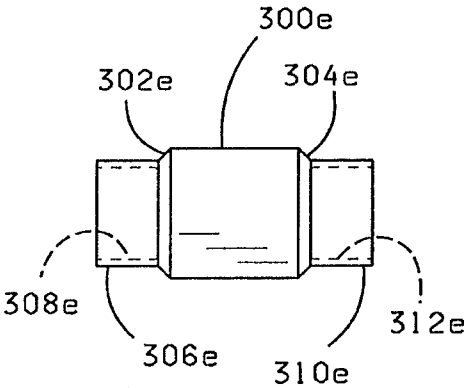
FIG. 10 is a side elevational view of a modified divider ring, similar to the divider ring shown in FIG. 10 for dividing the stabilizer chamber into a first chamber and a second chamber.

Shown in FIG. 10 is a side elevational view of a modified divider ring 300*e* which is constructed exactly like the divider ring 300 shown in FIG. 9, except the divider ring 300*e* does not include an opening extending therethrough like the opening 320 in the divider ring 300 shown in FIG. 9. The divider ring 300*e* is connected to the first tube segment 280 and the second tube segment 290 in a manner exactly like that described before in connection with FIG. 9. The divider ring 300*e* will not provide fluidic communication between the first chamber 262 and the second chamber 264 in the stabilizer tube 12*c*. Rather, the divider ring 300*e* fluidically isolates the first chamber 262 from the second chamber 264 of the stabilizer 12*c*.

Figure 11:
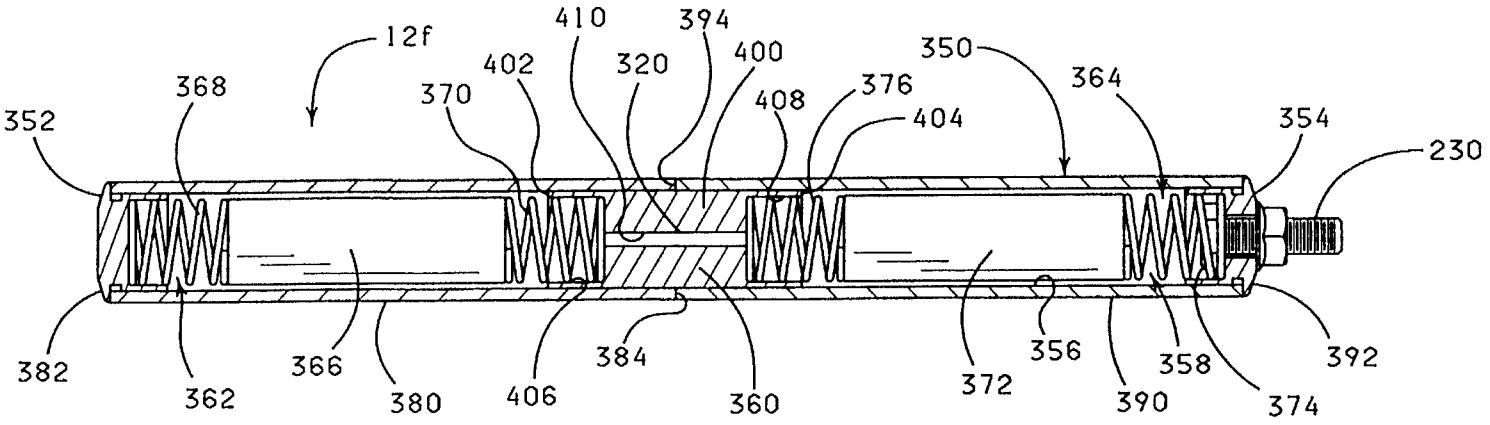
FIG. 11 is a sectional view of yet another modified stabilizer having a divider ring dividing the stabilizer tube into a first chamber and a second chamber.

Shown in FIG. 11 is another modified stabilizer 12*f* which is constructed similar to the stabilizer shown in FIG. 9. The stabilizer 12*f* comprises a stabilizer tube 350. The stabilizer tube 350 has a first end 352 and a second end 354. An opening 356 is formed through the stabilizer tube 350 forming a stabilizer chamber 358 within the stabilizer tube 350.

A divider 360 is interposed in the stabilizer tube 350 generally midway between the first and the second ends 352 and 354 dividing the stabilizer chamber 358 into a first chamber 362 extending generally between the first end 352 of the stabilizer tube 350 and the divider 360 and a second chamber 364 extending generally between the second end 354 of the stabilizer tube 350 and the divider 360.

A first piston 366 is disposed in the first chamber 362. A pair of springs 368 and 370 also are disposed in the first chamber 362. A portion of the spring 368 engages the first end 352 of the stabilizer tube 350 and another portion of the spring 368 engages one end of the first piston 366. One portion of the spring 370 engages one end of the first piston 366 and an opposite portion of the spring 370 engages a portion of the divider 360.

A piston 372 is disposed in the second chamber 364. A pair of springs 374 and 376 are disposed in the second chamber 364. A portion of the spring 374 engages the second end 354 of the stabilizer tube 350 and another portion of the spring 374 engages a portion of the piston 372. A portion of the spring 376 engages a portion of the piston 372 and another portion of the spring 376 engages a portion of the divider 260.

Air and/or hydraulic fluid may be disposed in either one or both of the chambers 362 and 364.

More particularly, the stabilizer tube 350 is divided into a first tube segment 380. The first tube segment 380 has a first end 382 forming the first end 352 of the stabilizer tube 350 and a second end 384. An opening is formed through the first tube segment 380 forming the first chamber 362. The stabilizer tube 350 also comprises a second tube segment 390 having a first end 392 forming the first end 354 of the stabilizer tube 350 and a second end 394. An opening is formed through the second tube segment 390 forming a second chamber 364.

Figure 12:
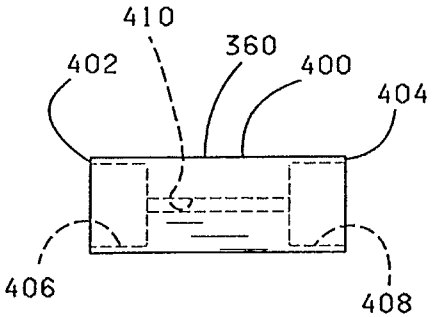
FIG. 12 is a side elevational view of the divider ring used in the stabilizer of FIG. 11.

The divider 360 (shown in FIGS. 11 and 12) comprises a divider ring 400 having a first end 402 and a second end 404. A recess 406 is formed in the first end 402 and a recess 408 is formed in the second end 404 of the divider ring 400.

An opening 410 is formed through the divider ring 400.

The second end 384 of the first tube segment 380 is press fitted over the first end 402 of the divider ring 400. The second end 394 of the second tube segment 390 is press fitted over the second end 404 of the divider ring 300.

It should be noted that in some embodiments as may be desired in a particular application, the opening 410 may be omitted or deleted so that the divider ring 400 fluidically isolates the first chamber 362 from the second chamber 364.

Figure 13:
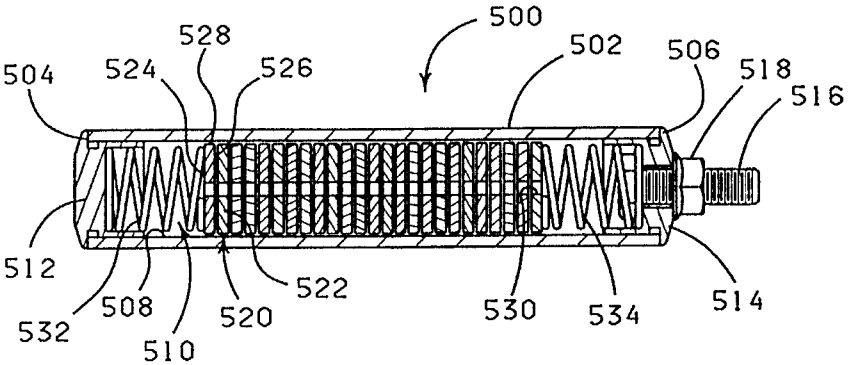
FIG. 13 is a sectional view of a stabilizer having a piston assembly comprising a plurality of piston rings.
Figure 14:
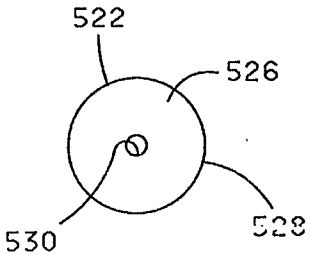
FIG. 14 is a plan view of a typical piston ring.

Shown in FIGS. 13 and 14 is a modified stabilizer 500. Stabilizer 500 comprises a stabilizer tube 502 having a first end 504 and a second end 506. An opening 508 is formed through the stabilizer tube 500 and defines a stabilizer chamber 510. The first and the second ends 504 and 506 of the stabilizer 500 are closed by way of caps 512 and 514, respectively, and a threaded member 516 and nut 518 are connected to the cap 514 for connecting the stabilizer 500 to the bow in the manner described before with respect to the other stabilizers disclosed herein.

A piston assembly 520 is slidingly disposed in the stabilizer chamber 510. The piston assembly 510 comprises at least two piston rings 522. Twenty five piston rings 522 are shown in FIG. 13, and shown in FIG. 14 is a plan view of a typical piston ring 522.

Each piston ring 522 is circularly shaped. Each piston ring 522 has a first surface 524 and a second surface 526. Each piston ring 522 has an outer peripheral edge 528.

The piston rings 522 are stacked with each piston ring 522 being disposed adjacent at least one of the other piston rings 522. The piston rings 522 are identical in construction. The diameter of each piston ring 522 is slightly less than the inner diameter of the stabilizer tube 500 so the piston rings 522 are slidingly disposed in the stabilizer chamber 510. In one preferred embodiment, there was a 0.006 inch clearance between the outer peripheral edges 528 of the piston rings 522 and the stabilizer tube 500, for example.

An opening 530 is formed through a central portion of each of the piston rings 522. When the piston rings 522 are stacked together to form the piston assembly 520, the openings 530 are generally aligned. The openings 530 provide a path for permitting fluid to flow through the piston assembly 520. In some applications, the openings 530 may be eliminated. If the openings 530 are eliminated, the fluid (oil) will flow around the piston assembly 520.

The stack of piston rings 522 creates a flexible, softer piston action. The piston assembly 520 resists movement and absorbs energy.

A first spring 532 is disposed in the stabilizer chamber 510. A portion of the first spring 532 engages a first end 504 of the stabilizer tube 502 or, more particularly, the cap 512, and another portion of the first spring 532 engages the piston assembly 520.

A second spring 534 is disposed in the stabilizer chamber 510. A portion of the second spring 534 engages a portion of the stabilizer tube 502, or, more particularly, the cap 514, and another portion of the second spring 534 engages a portion of the second piston 534.

The piston assembly 500 can be utilized in the stabilizers 12*a*, 12*b*, 12*c* or 12*f*.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A stabilizer for use with a bow comprising: a stabilizer tube having a first end and a second end, an opening being formed through the stabilizer tube forming a stabilizer chamber defining a stabilizer inner peripheral surface with the stabilizer inner peripheral surface defining a stabilizer inner diameter;

a resonator suppressor ring having a suppressor outer peripheral surface defining a suppressor outer diameter, the resonator suppressor ring being movable from a relaxed condition wherein the suppressor outer diameter is less than the stabilizer inner diameter to an expanded condition wherein the resonator suppressor ring outer diameter is greater than the stabilizer inner diameter; and an expander assembly connected to the resonator suppressor ring, the resonator suppressor ring being disposed in the stabilizer chamber and positioned between the first end and the second end of the stabilizer tube in the relaxed condition of the resonator suppressor ring, and the expander assembly moving the resonator suppressor ring from the relaxed condition to the expanded condition wherein the suppressor outer peripheral surface engages the stabilizer inner peripheral surface for connecting the resonator suppressor ring to the stabilizer tube, the resonator suppressor ring dividing the stabilizer chamber into a first chamber and a second chamber.

2. The stabilizer of claim 1 wherein the resonator suppressor ring is defined further as being constructed of an elastomeric compressible material.

3. The stabilizer of claim 1 wherein the resonator suppressor ring is defined further as being cylindrically shaped and including an expander opening formed through a central portion thereof forming an expander inner peripheral surface defining an expander inner diameter; and wherein the expander assembly is defined further to comprise:

a tapered member having a tapered surface formed thereon, at least a portion of the tapered member being disposed in the suppressor opening with a portion of the tapered surface of the tapered member engaging a portion of the suppressor inner peripheral surface; and means for moving the tapered member from one position wherein the tapered surface of the tapered member is substantially removed from the suppressor opening permitting the resonator suppressor ring to be moved to the relaxed condition and for moving the tapered member to one other position wherein the tapered surface of the tapered member engages a substantial portion of the suppressor inner peripheral surface formed by the expander opening for moving the resonator suppressor ring to the expanded position.

4. The stabilizer of claim 1 wherein the resonator suppressor ring is defined further as being cylindrically shaped.

5. The stabilizer of claim 1 wherein the resonator suppressor ring and the expander assembly are defined further as being constructed to fluidically isolate the first chamber from the second chamber.

6. A stabilizer comprising:

a stabilizer tube having a first end and a second end, an opening being formed through the stabilizer tube forming a stabilizer chamber defining a stabilizer inner peripheral surface with the stabilizer inner peripheral surface defining a stabilizer inner diameter;

a resonator suppressor ring having a suppressor outer peripheral surface defining a suppressor outer diameter, the resonator suppressor ring being movable from a relaxed condition wherein the suppressor outer diameter is less than the stabilizer inner diameter to an expanded condition wherein the resonator suppressor ring outer diameter is greater than the stabilizer inner diameter;

an expander assembly connected to the resonator suppressor ring, the resonator suppressor ring being disposed in the stabilizer chamber and positioned between the first end and the second end of the stabilizer tube in the relaxed condition of the resonator suppressor ring, and the expander assembly moving the resonator suppressor ring from the relaxed condition to the expanded condition wherein the suppressor outer peripheral surface engages the stabilizer inner peripheral surface for connecting the resonator suppressor ring to the stabilizer tube, the resonator suppressor ring dividing the stabilizer chamber into a first chamber and a second chamber;

a first piston disposed in the first chamber of the stabilizer tube;

a spring disposed in the first chamber with the spring engaging one end of the first piston and the spring engaging a portion of the stabilizer tube near the first end of the stabilizer tube and another spring disposed in the first chamber engaging a portion of the first piston and engaging a portion of the resonator suppressor ring;

a second piston disposed in the second chamber; and a spring disposed in the second chamber with the spring engaging one end of the second piston and the spring engaging a portion of the stabilizer tube near the second end of the stabilizer tube and another spring disposed in the second chamber engaging a portion of the second piston and engaging a portion of the resonator suppressor ring.

7. The stabilizer of claim 6 wherein the resonator suppressor ring is defined further as being constructed of an elastomeric compressible material.

8. The stabilizer of claim 6 wherein the resonator suppressor ring is defined further as being cylindrically shaped and including an expander opening formed through a central portion thereof forming an expander inner peripheral surface defining an expander inner diameter; and wherein the expander assembly is defined further to comprise:

a tapered member having a tapered surface formed thereon, at least a portion of the tapered member being disposed in the suppressor opening with a portion of the tapered surface of the tapered member engaging a portion of the suppressor inner peripheral surface; and means for moving the tapered member from one position wherein the tapered surface of the tapered member is substantially removed from the suppressor opening permitting the resonator suppressor ring to be moved to the relaxed condition and for moving the tapered member to one other position wherein the tapered surface of the tapered member engages a substantial portion of the suppressor inner peripheral surface formed by the expander opening for moving the resonator suppressor ring to the expanded position.

9. The stabilizer of claim 8 wherein the expander assembly further comprises:

a threaded member connected to the tapered member, the threaded member being disposed in the expander opening and extending through the expander opening and a portion of the threaded member extending a distance beyond the second end of the resonator suppressor ring; and a nut threadingly engaging the portion of the threaded member extending beyond the second end of the resonator suppressor ring, the threaded member being threadedly movable through the nut in one direction for moving the resonator suppressor ring from the expanded condition to the relaxed position and the threaded member being threadedly movable through the nut in one other direction for moving the resonator suppressor ring from the relaxed condition to the expanded position.

10. The stabilizer of claim 6 wherein the resonator suppressor ring is defined further as being cylindrically shaped.

11. The stabilizer of claim 6 wherein the resonator suppressor ring and the expander assembly are defined further as being constructed to fluidically isolate the first chamber from the second chamber.

12. The stabilizer of claim 6 wherein the first piston further comprises:

a piston assembly disposed in the stabilizer chamber comprising at least two circularly shaped piston rings, each piston ring having a first surface and a second surface and an outer peripheral edge, the piston rings being stacked with each piston ring being disposed adjacent at least one of the other piston rings, the piston rings being slidingly disposed in the first chamber; and wherein the second piston further comprises:

a piston assembly disposed in the stabilizer chamber comprising at least two circularly shaped piston rings, each piston ring having a first surface and a second surface and an outer peripheral edge, the piston rings being stacked with each piston ring being disposed adjacent at least one of the other piston rings, the piston rings being slidingly disposed in the second chamber.

13. The stabilizer of claim 12 wherein each piston ring further comprises an opening formed through a central portion thereof with the openings in the piston rings being aligned.

14. A stabilizer comprising:

a stabilizer tube having a first end and a second end, an opening being formed through the stabilizer tube forming a stabilizer chamber defining a stabilizer inner peripheral surface with the stabilizer inner peripheral surface defining a stabilizer inner diameter; and a resilient resonator suppressor ring having a suppressor outer peripheral surface defining a suppressor outer diameter, the resilient resonator suppressor ring being disposed in the opening in the stabilizer tube and positioned between the first end and the second end of the stabilizer tube, the resilient resonator suppressor ring being movable from a first condition wherein the suppressor outer diameter is less than the stabilizer inner diameter to a second condition wherein the resilient resonator suppressor ring outer diameter is greater than the stabilizer inner diameter.

15. The stabilizer of claim 14 wherein the resilient resonator suppressor ring divides the stabilizer chamber into a first chamber and a second chamber, and wherein the stabilizer further comprises:

a first piston disposed in the first chamber of the stabilizer tube;

a spring disposed in the first chamber with the spring engaging one end of the first piston and the spring engaging a portion of the stabilizer tube near the first end of the stabilizer tube and another spring disposed in the first chamber engaging a portion of the first piston and engaging a portion of the resilient resonator suppressor ring;

a second piston disposed in the second chamber of the stabilizer tube; and a spring disposed in the second chamber with the spring engaging one end of the second piston and the spring engaging a portion of the stabilizer tube near the second end of the stabilizer tube and another spring disposed in the second chamber engaging a portion of the second piston and engaging a portion of the resilient resonator suppressor ring.

16. A stabilizer comprising:

a stabilizer tube having a first end and a second end, an opening being formed through the stabilizer tube forming a stabilizer chamber defining a stabilizer inner peripheral surface with the stabilizer inner peripheral surface defining a stabilizer inner diameter;

a resonator suppressor ring having a suppressor outer peripheral surface defining a suppressor outer diameter, the resonator suppressor ring being movable from a relaxed condition wherein the suppressor outer diameter is less than the stabilizer inner diameter to an expanded condition wherein the resonator suppressor ring outer diameter is greater than the stabilizer inner diameter; and an expander assembly connected to the resonator suppressor ring, the resonator suppressor ring being disposed in the stabilizer chamber and positioned between the first end and the second end of the stabilizer tube in the relaxed condition of the resonator suppressor ring, and the expander assembly moving the resonator suppressor ring from the relaxed condition to the expanded condition wherein the suppressor outer peripheral surface engages the stabilizer inner peripheral surface for connecting the resonator suppressor ring to the stabilizer tube, the resonator suppressor ring dividing the stabilizer chamber into a first chamber and a second chamber;

wherein the resonator suppressor ring is defined further as being cylindrically shaped and including an expander opening formed through a central portion thereof forming an expander inner peripheral surface defining an expander inner diameter; and wherein the expander assembly is defined further to comprise:

a tapered member having a tapered surface formed thereon, at least a portion of the tapered member being disposed in the suppressor opening with a portion of the tapered surface of the tapered member engaging a portion of the suppressor inner peripheral surface; and means for moving the tapered member from one position wherein the tapered surface of the tapered member is substantially removed from the suppressor opening permitting the resonator suppressor ring to be moved to the relaxed condition and for moving the tapered member to one other position wherein the tapered surface of the tapered member engages a substantial portion of the suppressor inner peripheral surface formed by the expander opening for moving the resonator suppressor ring to the expanded condition;

wherein the expander assembly further comprises:

a threaded member connected to the tapered member, the threaded member being disposed in the expander opening and extending through the expander opening and a portion of the threaded member extending a distance beyond the second end of the resonator suppressor ring;

a nut threadingly engaging the portion of the threaded member extending beyond the second end of the resonator suppressor ring, the threaded member being threadedly movable through the nut in one direction for moving the resonator suppressor ring from the expanded condition to the relaxed condition and the threaded member being threadedly movable through the nut in one other direction for moving the resonator suppressor ring from the relaxed condition to the expanded condition.

17. A stabilizer comprising:

a stabilizer tube having a first end and a second end, an opening being formed through the stabilizer tube forming a stabilizer chamber defining a stabilizer inner peripheral surface with the stabilizer inner peripheral surface defining a stabilizer inner diameter;

a resonator suppressor ring having a suppressor outer peripheral surface defining a suppressor outer diameter, the resonator suppressor ring being movable from a relaxed condition wherein the suppressor outer diameter is less than the stabilizer inner diameter to an expanded condition wherein the resonator suppressor ring outer diameter is greater than the stabilizer inner diameter; and an expander assembly connected to the resonator suppressor ring, the resonator suppressor ring being disposed in the stabilizer chamber and positioned between the first end and the second end of the stabilizer tube in the relaxed condition of the resonator suppressor ring, and the expander assembly moving the resonator suppressor ring from the relaxed condition to the expanded condition wherein the suppressor outer peripheral surface engages the stabilizer inner peripheral surface for connecting the resonator suppressor ring to the stabilizer tube, the resonator suppressor ring dividing the stabilizer chamber into a first chamber and a second chamber;

a first piston disposed in the first chamber of the stabilizer tube;

a spring disposed in the first chamber with the spring engaging one end of the first piston and the spring engaging a portion of the stabilizer tube near the first end of the stabilizer tube and another spring disposed in the first chamber engaging a portion of the first piston and engaging a portion of the resonator suppressor ring;

a second piston disposed in the second chamber; and a spring disposed in the second chamber with the spring engaging one end of the second piston and the spring engaging a portion of the stabilizer tube near the second end of the stabilizer tube and another spring disposed in the second chamber engaging a portion of the second piston and engaging a portion of the resonator suppressor ring; and wherein the first piston further comprises a piston assembly disposed in the stabilizer chamber comprising at least two circularly shaped piston rings, each piston ring having a first surface and a second surface and an outer peripheral edge, the piston rings being stacked with each piston ring being disposed adjacent at least one of the other piston rings, the piston rings being slidingly disposed in the first chamber; and wherein the second piston further comprises:

a piston assembly disposed in the stabilizer chamber comprising at least two circularly shaped piston rings, each piston ring having a first surface and a second surface and an outer peripheral edge, the piston rings being stacked with each piston ring being disposed adjacent at least one of the other piston rings, the piston rings being slidingly disposed in the second chamber.

18. The stabilizer of claim 17 wherein each piston ring further comprises an opening formed through a central portion thereof with the openings in the piston rings being aligned.

19. A stabilizer comprising:

a stabilizer tube having a first end and a second end, an opening being formed through the stabilizer tube forming a stabilizer chamber defining a stabilizer inner peripheral surface with the stabilizer inner peripheral surface defining a stabilizer inner diameter;

a resonator suppressor ring having a suppressor outer peripheral surface defining a suppressor outer diameter, the resonator suppressor ring being movable from a relaxed condition wherein the suppressor outer diameter is less than the stabilizer inner diameter to an expanded condition wherein the resonator suppressor ring outer diameter is greater than the stabilizer inner diameter;

an expander assembly connected to the resonator suppressor ring, the resonator suppressor ring being disposed in the stabilizer chamber and positioned between the first end and the second end of the stabilizer tube in the relaxed condition of the resonator suppressor ring, and the expander assembly moving the resonator suppressor ring from the relaxed condition to the expanded condition wherein the suppressor outer peripheral surface engages the stabilizer inner peripheral surface for connecting the resonator suppressor ring to the stabilizer tube, the resonator suppressor ring dividing the stabilizer chamber into a first chamber and a second chamber;

a first piston disposed in the first chamber of the stabilizer tube;

spring means disposed in the first chamber engaging the stabilizer tube and the first piston;

a second piston disposed in the second chamber; and spring means disposed in the second chamber engaging a portion of the stabilizer tube and the second piston.

20. A stabilizer comprising:

a stabilizer tube having a first end and a second end, an opening being formed through the stabilizer tube forming a stabilizer chamber defining a stabilizer inner peripheral surface with the stabilizer inner peripheral surface defining a stabilizer inner diameter;

a resonator suppressor ring having a suppressor outer peripheral surface defining a suppressor outer diameter, the resonator suppressor ring being movable from a relaxed condition wherein the suppressor outer diameter is less than the stabilizer inner diameter to an expanded condition wherein the resonator suppressor ring outer diameter is greater than the stabilizer inner diameter; and an expander assembly connected to the resonator suppressor ring, the resonator suppressor ring being disposed in the stabilizer chamber and positioned between the first end and the second end of the stabilizer tube in the relaxed condition of the resonator suppressor ring, and the expander assembly moving the resonator suppressor ring from the relaxed condition to the expanded condition wherein the suppressor outer peripheral surface engages the stabilizer inner peripheral surface for connecting the resonator suppressor ring to the stabilizer tube, the resonator suppressor ring dividing the stabilizer chamber into a first chamber and a second chamber;

a first piston disposed in the first chamber of the stabilizer tube;

spring means disposed in the first chamber engaging a portion of the stabilizer tube and the second piston;

a second piston disposed in the second chamber; and spring means disposed in the second chamber engaging a portion of the stabilizer tube and the second piston; and wherein the first piston further comprises a piston assembly disposed in the stabilizer chamber comprising at least two circularly shaped piston rings, each piston ring having a first surface and a second surface and an outer peripheral edge, the piston rings being stacked with each piston ring being disposed adjacent at least one of the other piston rings, the piston rings being slidingly disposed in the first chamber; and wherein the second piston further comprises:

a piston assembly disposed in the stabilizer chamber comprising at least two circularly shaped piston rings, each piston ring having a first surface and a second surface and an outer peripheral edge, the piston rings being stacked with each piston ring being disposed adjacent at least one of the other piston rings, the piston rings being slidingly disposed in the second chamber.

* * * * *

UNITED STATES PATENT AND TRADEMARK OFFICE

CERTIFICATE OF CORRECTION

PATENT NO. : 5,471,969

DATED : December 5, 1995

INVENTOR(S) : Norman J. McDonald, Jr.

It is certified that error appears in the above-identified patent and that said Letters Patent is hereby corrected as shown below:

Column 2, line 24, please delete "34", and substitute therefor --32--.

Column 4, line 19, please delete "a", and substitute therefor --an--.

Column 8, line 9, please delete "first", and substitute therefor --second--. (2nd occurence)

Column 9, line 8, please delete "second".

Column 9, line 8, please delete "534", and substitute therefor --assembly 520--.

Column 9, line 9, please delete "500", and substitute therefor --520--.

Signed and Sealed this

Fourth Day of June, 1996

Bruce Lehman

*Attest:*

BRUCE LEHMAN

*Attesting Officer*

*Commissioner of Patents and Trademarks*